US012163284B2

(12) United States Patent
Sugiyama et al.

(10) Patent No.: US 12,163,284 B2
(45) Date of Patent: Dec. 10, 2024

(54) FIBERBOARD MANUFACTURING METHOD AND FIBERBOARD

(71) Applicant: NICHIHA CORPORATION, Nagoya (JP)

(72) Inventors: Naoki Sugiyama, Nagoya (JP); Toshikatsu Homma, Nagoya (JP)

(73) Assignee: NICHIHA CORPORATION, Nagoya (JP)

( * ) Notice: Subject to any disclaimer, the term of this patent is extended or adjusted under 35 U.S.C. 154(b) by 221 days.

(21) Appl. No.: 17/434,667

(22) PCT Filed: Mar. 18, 2020

(86) PCT No.: PCT/JP2020/012102
§ 371 (c)(1),
(2) Date: Aug. 27, 2021

(87) PCT Pub. No.: WO2020/196188
PCT Pub. Date: Oct. 1, 2020

(65) Prior Publication Data

US 2022/0170207 A1 Jun. 2, 2022

(30) Foreign Application Priority Data

Mar. 28, 2019 (JP) ..... 2019-064607

(51) Int. Cl.
*D21D 1/20* (2006.01)
*D21J 5/00* (2006.01)

(52) U.S. Cl.
CPC . *D21D 1/20* (2013.01); *D21J 5/00* (2013.01)

(58) Field of Classification Search
CPC ..... D21D 1/20; D21J 1/04; D21J 5/00; B27N 1/00; B27N 3/002; B27N 3/04
See application file for complete search history.

(56) References Cited

U.S. PATENT DOCUMENTS 4,857,252 A * 8/1989 Melchior ..... B62D 29/02 264/109
4,941,948 A 7/1990 Yamamoto
2020/0206969 A1* 7/2020 Pans ..... B27N 3/002

FOREIGN PATENT DOCUMENTS

EP 0097716 B1 * 3/1983 ..... B27N 3/00
EP 0967326 A2 * 6/1999 ..... D21G 9/00
(Continued)

OTHER PUBLICATIONS

English translation of the description of JP-2008213370-A retrieved on espacenet on Jun. 21, 2023 (Year: 2023).*
(Continued)

*Primary Examiner* — Dennis R Cordray
*Assistant Examiner* — Elisa H Vera
(74) *Attorney, Agent, or Firm* — Kratz, Quintos & Hanson, LLP

(57) ABSTRACT

[Object] To provide a fiberboard manufacturing method that is suitable for efficiently manufacturing a fiberboard in which warpage is suppressed, and to provide a fiberboard that is obtained by such a fiberboard manufacturing method. [Solution] The fiberboard manufacturing method of the present invention includes the following pulp crushing step S1, mat forming step S2, and hot-pressing step S3. In the pulp crushing step S1, pulp dispersed in water is beaten in a gap between opposed blades to thereby produce a plant-based fiber material that has a particle size D50 of 50 to 110 μm and a freeness value of 150 to 300 ml and that contains an adhesive component. In the mat forming step S2, a mat is formed from the plant-based fiber material. In the hot-pressing step S3, by hot-pressing the mat, a fiberboard is formed from the mat through a process of plasticizing the adhesive component in the mat.

6 Claims, 1 Drawing Sheet

(56) References Cited

FOREIGN PATENT DOCUMENTS

| | | | | |
|---|---|---|---|---|
| JP | S60-190322 | A | | 9/1985 |
| JP | S63-295800 | A | | 12/1988 |
| JP | 2003-201695 | A | | 7/2003 |
| JP | 2003-285305 | A | | 10/2003 |
| JP | 2007-231438 | A | | 9/2007 |
| JP | 2008213370 | A | * | 9/2008 |
| JP | 2020-066808 | A | | 4/2020 |
| WO | 2017/200452 | A1 | | 11/2017 |

OTHER PUBLICATIONS

English Translation of EP0967326A2 retrieved from Espacenet (Year: 2023).*

Office Action of Japanese Patent Application No. JP 2019-064607: Notice of Reasons for Refusal dated Jul. 5, 2022 (4 sheets, 5 sheets translation, 9 sheets total).

International Search Report for International Application No. PCT/JP2020/012102 dated Jun. 9, 2020 (3 sheets).

International Preliminary Report on Patentability for International Application No. PCT/JP2020/012102 dated Sep. 28, 2021 (7 sheets).

Written Opinion of the International Searching Authority for International Application No. PCT/JP2020/012102 dated Jun. 9, 2020 (6 sheets).

* cited by examiner

FIBERBOARD MANUFACTURING METHOD AND FIBERBOARD

TECHNICAL FIELD

The present invention relates to a manufacturing method of a fiberboard that can be used for, for example, a building material or a furniture material, and the fiberboard.

BACKGROUND ART

As a building material or a furniture material, a fiberboard may be used. In recent years, a fiberboard that is manufactured through sheet forming and thermocompression molding from a fine fiber material obtained by making pulp finer has been attracting attention. A technology that is related to such a fiberboard is described in, for example, Patent Literature 1 below.

CITATION LIST

Patent Literature

PTL 1: Japanese Unexamined Patent Application Publication No. 2003-201695

SUMMARY OF INVENTION

Technical Problem

In conventionally manufacturing a fiberboard, regarding a fiber material in a raw material that is subjected to thermocompression molding, a fiber material in which a fiber is made finer by wet-crushing or dry-crushing raw-material pulp may be used. For the wet-crushing, for example, a millstone-type wet grinder is used, and, for the dry-crushing, a hammer-type grinder is used. With a mat having a predetermined thickness being formed by dispersing in water the fiber material, obtained as a result of crushing the raw-material pulp, and by subjecting the fiber material to sheet forming, a fiberboard is formed by compression molding from the mat.

However, although the fiber material obtained through the wet-grinding has high strength, it takes a long time of about a few hours to perform the wet-crushing. In addition, the fiber material obtained by wet-crushing the raw-material pulp tends to have an excessively small particle-size distribution, and therefore tends to have difficulty separating from water (that is, tends to have low drainage). Likewise, it tends to take a long time to perform the sheet forming for forming the aforementioned mat from a slurry containing such a fiber material. That these steps take a long time to perform is not desirable from the viewpoint of efficiently manufacturing the fiberboard. Further, the obtained fiber material is also largely warped.

Although a fiber material obtained through the dry-crushing can be manufactured in a short time and has small warpage, since the tensile strength of the mat is small, poor handling of the fiber material before pressing results.

The present invention has been made under such circumstances, and an object of the present invention is to provide a fiberboard manufacturing method that is suitable for efficiently manufacturing a fiberboard in which warpage is suppressed, and to provide a fiberboard that is obtained by such a fiberboard manufacturing method.

Solution to Problem

According to a first aspect of the present invention, a fiberboard manufacturing method is provided. The fiberboard manufacturing method includes the following first step, second step, and third step.

In the first step, pulp dispersed in water is beaten in a gap between opposed blades to thereby produce a plant-based fiber material that has a particle size D50 of 50 to 110 μm and a freeness value of 150 to 300 ml and that contains an adhesive component. The freeness value in the present invention is a Canadian standard freeness value, and can be measured in conformity with JIS P 8121-2 (pulp-freeness testing method).

In the second step, a mat is formed from the plant-based fiber material.

In the third step, by hot-pressing the mat, a fiberboard is formed from the mat through a process of plasticizing the adhesive component in the mat.

The plant-based fiber material that contains the adhesive component and that has the particle size D50 of 50 to 110 μm and the freeness value of 150 to 300 ml separates relatively easily from water (that is, has relatively high drainage), when the mat is formed by sheet forming from a slurry that contains the plant-based fiber material. Therefore, the present manufacturing method is suitable for reducing the time taken to perform a fiberboard manufacturing process.

Even if the mat is formed through the sheet forming, the plant-based fiber material that contains the adhesive component and that has the particle size D50 of 50 to 110 μm and the freeness value of 150 to 300 ml has a low moisture content and is contracted by a small amount in a process of drying humidity control of the mat. The contraction that occurs in the mat that is subjected to the hot-pressing step may induce distortion in the mat and may cause warpage in the fiberboard that is formed through the hot-pressing step. However, in the mat that is formed from the plant-based fiber material that is obtained by the present manufacturing method, such a contraction is small. Therefore, in the fiberboard that is formed from the mat of the plant-based fiber material that is obtained by the present manufacturing method, the warpage is thought to be suppressed. In addition, as a result of proper fibrillation by the beating, at the time of mat molding, fibers are intertwined and the tensile strength of the mat is high. Therefore, handling is thought to be good.

As described above, the fiberboard manufacturing method according to the first aspect of the present invention is suitable for efficiently manufacturing a fiberboard in which warpage is suppressed.

A water retention rate of the plant-based fiber material that is produced in the first step is desirably 2000% or less and is more desirably 1800 to 2000%. The water retention rate in the present invention is, with regard to a precipitate that is produced by subjecting a water dispersion liquid having a plant-based fiber material concentration of 0.5 mass % to centrifugal separation at 1000 G for 15 minutes, the ratio (%) of a difference between the weight after separation from a supernatant liquid and before drying and the weight after drying for 24 hours at 105° C. with respect to the weight after the drying.

Such a structure is suitable for efficiently manufacturing a fiberboard in which warpage is suppressed. Specifically, the structure is suitable for reducing the time taken to perform the fiberboard manufacturing process when the mat forming technique is used in the second step.

A particle size D90 of the plant-based fiber material that is produced in the first step is desirably 300 to 700 μm. According to such a structure, in the third step, the adhesive component is caused to exude from the plant-based fiber material and a sufficient amount of adhesive component is easily plasticized.

In the first step, when the plant-based fiber material is produced by beating pulp having a lignin content ratio of 18 to 35 mass %, it is easier for the plant-based fiber material to have a suitable particle size and a suitable freeness value, and this is desirable.

In the present invention, the lignin content ratio is a quantitative value obtained by the so-called Klason method. Such a structure that is related to the content ratio of the lignin that is capable of functioning as the adhesive component is suitable for realizing high strength, such as high bending strength, in the fiberboard that is to be manufactured.

In the second step, the mat is formed by the sheet forming from a slurry prepared by dispersing the plant-based fiber material in water.

In the third step, the fiberboard is desirably formed from only the plant-based fiber material and the adhesive component. Such a structure is suitable for efficiently manufacturing a fiberboard having high strength, such as high bending strength. In addition, a fiberboard that is formed from only a natural material without intentionally containing, for example, plastic or metal as a fiberboard constituent material is desirable in terms of the environment.

According to a second aspect of the present invention, a fiberboard is provided. The fiberboard contains a plant-based fiber material and an adhesive component derived from the plant-based fiber material, and has a bending strength of 150 $N/mm^2$ or greater, a bending elastic modulus of 9 GPa or greater, and a warpage of 2 mm or less per length of 70 mm.

In the present invention, the bending strength of the fiberboard is a strength that is determined by measuring a fiberboard test piece by a three-point bending test in conformity with JIS A 1408 at a temperature of 60° C. in a dry state, the test piece being obtained by cutting out a portion of the fiberboard to a size of 40 mm×10 mm.

In the present invention, the bending elastic modulus of the fiberboard is a physical property that is indicated by an initial gradient of a load-displacement curve that can be obtained in the aforementioned three-point bending test.

In the present invention, the warpage of the fiberboard is, with regard to the fiberboard test piece, a maximum displacement from a position (reference position) at which a surface of the fiberboard test piece can be positioned when there is no warpage at all to a position (position of the surface of the test piece on an inner side of a curve shape) at which the surface of the test piece is actually positioned.

Such a fiberboard according to the second aspect of the present invention can be manufactured by the aforementioned fiberboard manufacturing method according to the first aspect of the present invention. Therefore, the fiberboard according to the second aspect of the present invention is suitable for being efficiently manufactured and is suitable for suppressing warpage.

In the present fiberboard, the adhesive component desirably contains lignin. More desirably, the ratio of the lignin in the total amount of the plant-based fiber material and the adhesive component in the present fiberboard is 18 to 35 mass %. Such a structure that is related to the content ratio of the lignin that is capable of functioning as the adhesive component is suitable for realizing high strength, such as high bending strength, in the present fiberboard.

The present fiberboard desirably contains only the plant-based fiber material and the adhesive component as constituent components. A fiberboard that is formed from only a natural material without intentionally containing, for example, plastic or metal as a fiberboard constituent material is desirable in terms of the environment.

DESCRIPTION OF EMBODIMENTS

Figure 1:
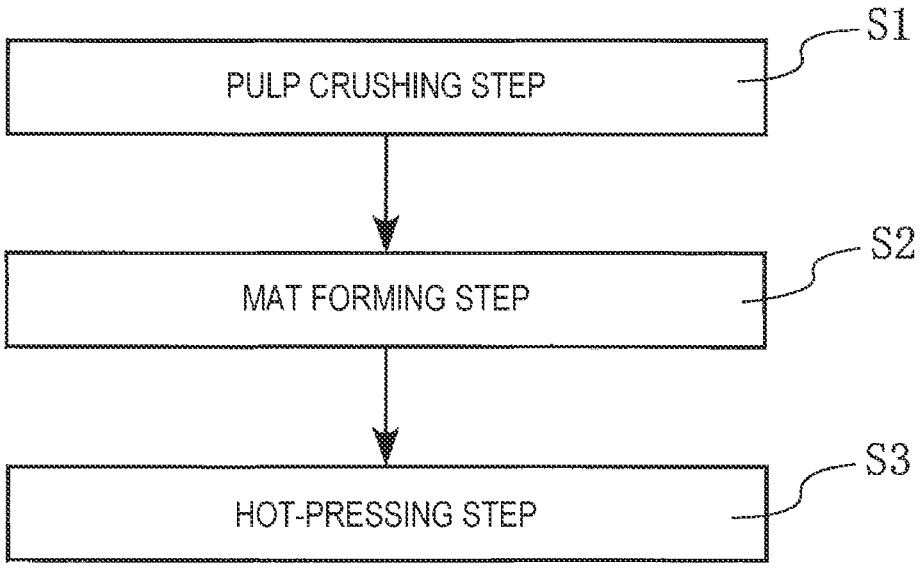
FIG. 1 illustrates the steps of a fiberboard manufacturing method according to an embodiment of the present invention.
Figure 2:
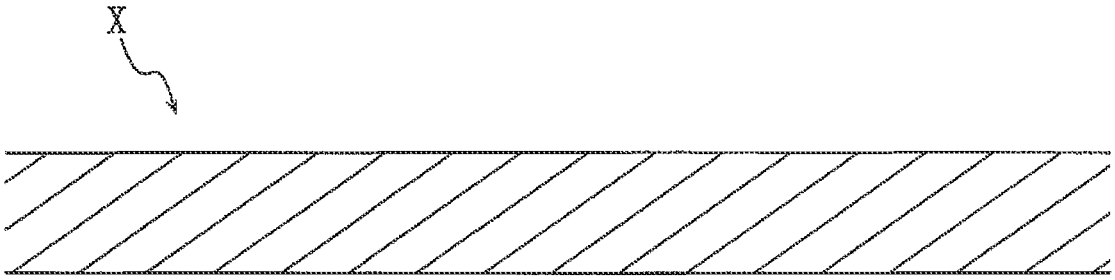
FIG. 2 is a partial sectional schematic view of a fiberboard according to an embodiment of the present invention.

FIG. 1 illustrates the steps of a fiberboard manufacturing method according to an embodiment of the present invention. The present manufacturing method is, for example, a method for manufacturing a fiberboard X as schematically illustrated in FIG. 2, and, in the present embodiment, includes at least a pulp crushing step S1, a mat forming step S2, and a hot-pressing step S3. The fiberboard X is a compression molded body of a plant-based fiber material, and is usable as, for example, a building material, such as a wall material, a ceiling material, a heat insulation material, or a sound absorbing material, and a furniture material.

In the pulp crushing step S1 (first step), raw-material pulp is beaten to produce a plant-based fiber material that contains an adhesive component. Specifically, first, the pulp is dispersed in water to form a slurry having a pulp concentration of 1 to 10%. Then, the slurry is injected into a gap between opposed blades and the slurry is beaten with the blades to produce the plant-based fiber material that has a particle size D50 of 50 to 110 μm and a freeness value of 150 to 300 ml and that contains the adhesive component. The beating refers to applying a strong compressive force and a strong shearing force to a fiber by causing the fiber to pass through the gap between the opposed blades, and is performed a plurality of times. The blades are metal components having a shape that allows the pulp to be beaten, and those in which a plurality of metal teeth are disposed on a disc are exemplified. By rotating the disc, the pulp is beaten. The gap between the blades only needs to be one that allows the beating of the pulp, and is adjusted, for example, in a range of 0.05 to 2.0 mm in accordance with the particle size of the fiber. The freeness value is a Canadian standard freeness (CSF) value, and can be measured in conformity with JIS P 8121-2 (pulp-freeness testing method).

As the raw-material pulp, for example, chemithermomechanical pulp or then mechanical pulp can be used. The lignin content ratio of the raw-material pulp is desirably 18 to 35 mass %, and a first adhesive component that is contained is the plant-based fiber material that is to be produced from the raw-material pulp is desirably lignin.

The beating in the present step can be performed by using, for example, a single disc refiner, a double disc refiner, a single conical refiner, or a double conical refine.

The particle size D50 of the plant-based fiber material that is produced is the present step is 50 to 110 μm as described above, and is desirably 80 μm or less. In addition, a particle size D90 of the plant-based fiber material that is produced in the present step is desirably 300 to 700 μm, and is more desirably 300 to 400 μm.

A water retention rate of the plant-based fiber material that is produced in the present step is desirably 2000% or less, and is more desirably 1800 to 2000%. The water retention rate is, with regard to a precipitate that is produced by subjecting a water dispersion liquid having a plant-based fiber material concentration of 0.5 mass % to centrifugal separation at 1000 G for 1.5 minutes, the ratio (%) of a difference between the weight after separation from a supernatant liquid and before drying and the weight after drying for 24 hours at 105° C. with respect to the weight after the drying.

In the mat forming step S2 (second step), a mat is formed from the plant-based fiber material.

In a wet method, the mat is formed by sheet forming from a slurry that contains the plant-based fiber material. The slurry can be prepared by dispersing a predetermined amount of plant-based fiber material in water. A solid concentration (plant-based fiber material concentration) of the slurry is, for example, 1 to 5 mass %. It is desirable to dry the mat that is formed by the sheet forming and adjust its water content ratio. The adjusted water content ratio of the mat is, for example, 5 to 15% under the conditions of 20° C. and 65% RH. In the present embodiment, the mat is pre-pressed. The load in the pre-pressing is, for example, 1 to 5 MPa.

The plant-based fiber material that is subjected to such a mat forming step S2 may be a plant-based fiber material itself that contains the adhesive component and that is produced in the aforementioned pulp crushing step S1, or may be one in which, as a fiberboard constituent component, another component is added to the plant-based fiber material. When the plant-based fiber material is subjected to the mat forming step S2 without adding another component to the plant-based fiber material that contains the adhesive component and that is produced in the pulp crushing step S1, the fiberboard X that is formed from only the plant-based fiber material and the adhesive component can be manufactured by the present manufacturing method.

In the hot-pressing step S3 (third step), by hot-pressing the mat, the fiberboard X is formed from the mat through a process of plasticizing the adhesive component in the mat. In the present step, for example, a pair of stainless-steel plates that sandwich the mat to be hot-pressed is placed between a pair of hot plates of a hot-pressing device, and the mat that is placed between the stainless-steel plates is hot-pressed between the hot plates that are set at a predetermined heating temperature.

When the mat is formed by the aforementioned wet method in the mat forming step S2, the press temperature in the hot-pressing step S3 with respect to the mat is, for example, 170 to 200° C., and, desirably, 180 to 190° C.; the press pressure is, for example, 20 to 95 MPa, and, desirably, 30 to 50 MPa; and the press time is, for example, 1 to 30 minutes, and, desirably, 3 to 10 minutes.

After the hot-pressing step S3, for example, with a load being applied between the stainless-steel plates, the temperature between the hot plates of the device and, therefore, the temperature between the stainless-steel plates is reduced to 95° C. or less.

Through the pulp crushing step S1, the mat forming step S2, and the hot-pressing step S3 described above, the fiberboard X that has a bending strength of 150 N/mm$^2$ or greater, a bending elastic modulus of 9 GPa or greater, and a warpage of 2 mm or less per length of 70 mm can be manufactured from the aforementioned plant-based fiber material that contains the adhesive component. The fiberboard X desirably contains lignin as the adhesive component, and the ratio of the lignin in the total amount of the plant-based fiber material and the adhesive component in the fiberboard X is desirably 18 to 35 mass %.

The lignin content ratio can be measured by the so-called Klason method. The Klason method is a method in which, by treating the plant-based fiber material, such as pulp, with concentrated sulfuric acid, cellulose and hemicellulose in the plant-based fiber material are caused to undergo hydrolysis and are dissolved to determine the quantity of a remaining portion as Klason lignin. In the present invention, lignin refers to this Klason lignin.

In the pulp crushing step S1 of the present manufacturing method, as described above, a predetermined plant-based fiber material is produced by beating. That the plant-based fiber material that has the particle size D50 of 50 to 110 μm and the freeness value of 150 to 300 ml and that contains the adhesive component can be produced by the beating is as illustrated in the examples and comparative examples described below. The present manufacturing method in which beating is performed instead of wet-grinding in obtaining a plant-based fiber material is suitable for reducing the time taken to perform a fiberboard manufacturing process.

The aforementioned plant-based fiber material that has the particle size D50 of 50 to 110 μm and the freeness value of 150 to 300 ml separates relatively easily from water (that is, has relatively high drainage), when the mat is formed by the sheet forming from a slurry that contains the plant-based fiber material. Therefore, even when the mat is formed by the wet method in the mat forming step S2, the present manufacturing method is suitable for reducing the time taken to perform the fiberboard manufacturing process.

Regarding the fiberboard X that is manufactured by compression molding from the plant-based fiber material that contains the adhesive component and that has the particle size D50 of 50 to 110 μm and the freeness value of 150 to 300 ml, warpage is suppressed. For example, the warpage is as indicated in the examples of the comparative examples below.

Compared with a plant-based fiber material that has been made finer by conventional wet-grinding, even if the mat is formed through the sheet forming, the plant-based fiber material that contains the adhesive component and that has the particle size D50 of 50 to 110 μm and the freeness value of 100 to 300 ml has a lower moisture content and is contracted by a smaller amount in a process of drying/humidity control of the mat. The contraction that occurs in the mat that is subjected to the hot-pressing step may induce distortion in the mat and may cause warpage in the fiberboard that is formed through the hot-pressing step. However, in the mat that is formed from the plant-based fiber material that is obtained by the present manufacturing method, such a contraction is small. Therefore, in the fiberboard that is formed from the mat of the plant-based fiber material that is obtained by the beating, the warpage is thought to be suppressed. In addition, as a result of proper fibrillation by the beating, at the time of mat molding, fibers are intertwined and the tensile strength of the mat is high. Therefore, handling is thought to be better than that of a mat of a plant-based fiber material that is obtained by dry-crushing.

As described above, the present fiberboard manufacturing method is suitable for efficiently manufacturing the fiberboard X in which warpage is suppressed.

As described above, the water retention rate of the plant-based fiber material that is produced in the pulp crushing step S1 is desirably 2000% or less, and is more desirably 1800 to 2000%. Such a structure is suitable for efficiently manufacturing the fiberboard X in which warpage is suppressed. Specifically, the structure is suitable for reducing the time taken to perform the fiberboard manufacturing process when the mat is formed by the wet method in the mat forming step S2.

As described above, the particle size D50 of the plant-based fiber material that is produced in the pulp crushing step S1 is 50 to 110 μm. Such a structure is suitable for efficiently manufacturing a fiberboard in which warpage is suppressed with a bending strength being high, while the time taken to perform the beating in the pulp crushing step S1 is reduced.

The particle size D90 of the plant-based fiber material that is produced in the pulp crushing step S1 is desirably 300 to 700 μm. According to such a structure, in the hot-pressing step S3, the adhesive component is caused to exude from the plant-based fiber and a sufficient amount of adhesive component is easily plasticized.

In the pulp crushing step S1, desirably, pulp that has the lignin content ratio of 18 to 35 mass % is beaten to produce the plant-based fiber material. Such a structure that is related to the content ratio of the lignin that is capable of functioning as the adhesive component is suitable for realizing high strength, such as high bending strength, in the fiberboard X that is to be manufactured.

The fiberboard X that is manufactured by the present manufacturing method may be formed from only the plant-based fiber material and the adhesive component. When the fiberboard X is formed from only a natural material without intentionally containing, for example, plastic or metal as a fiberboard constituent material, such a fiberboard X is desirable in terms of the environment.

EXAMPLES

Fiberboards according to samples 1 to 8 were manufactured, and the thickness, the bending strength, the bending elastic modulus, the specific gravity in absolute dry condition, and warpage of each of the fiberboards were examined.

[Sample 1]

The pulp fiberboard of sample 1 was manufactured through a pulp crushing step, a mat for step, and a hot-pressing step as those below.

In the pulp crushing step, thermal mechanical pulp (TMP) having a freeness value greater than 800 ml was dispersed in water, and a slurry having a pulp concentration of 3% was beaten by using a single disc refiner. Specifically, a gap between opposed blades of the single disc refiner was adjusted to a range of 0.1 to 2 mm in accordance with the particle size of the pulp, and the slurry was injected into the gap between the opposed blades and was beaten. The beating was performed 10 times. Note that the TMP that was used was one containing 31 mass % of lignin as an adhesive component.

When a plant-based fiber material obtained by such a pulp crushing step and containing the adhesive component was subjected to particle-size-distribution analysis based on a laser diffraction/scattering method by using a particle-size-distribution measuring device (product name: "MT3500", manufactured by Microtrac), the particle size D10 was 20.2 μm, the particle size D50 was 98.2 μm, and the particle size D90 was 615.3 μm. The results are shown in Table 1 (the results of particle-size-distribution measurements of plant-based fiber materials obtained by pulp crushing steps of manufacturing processes of the other samples below and containing an adhesive component are also shown in Table 1).

When the Canadian standard freeness of the plant-based fiber material obtained through the aforementioned pulp crushing step and containing the adhesive component was examined in conformity with JIS P 8121-2 (pulp-freeness testing method), the freeness value (CSF) was 240 ml. The result is shown in Table 1 (the results of freeness measurements of the plant-based fiber materials obtained by the pulp crushing steps of the manufacturing processes of the other samples below and containing an adhesive component are also shown in Table 1).

When the water retention rate of the plant-based fiber material obtained through the aforementioned pulp beating step and containing the adhesive component was examined, the measured value was 1865%. The result of the water-retention-rate measurement is shown in Table 1 (the results of water-retention-rate measurements of the plant-based fiber materials obtained by the pulp crushing steps of the manufacturing processes of the other samples below and containing an adhesive component are also shown in Table 1).

In measuring the water retention ratio, first, water and the plant-based fiber material were mixed to prepare a dispersion liquid having a solid concentration of 0.5 mass %. Next, the dispersion liquid was subjected to centrifugal separation under the conditions of a centrifugal force of 1000 G and a centrifugal time of 15 minutes. Next, after separating a precipitant produced by the centrifugal separation from a supernatant liquid, the weight (W1) of the precipitant was measured. Next, after drying the precipitant for 24 hours and at a temperature of 105° C., its weight (W2) was measured. Then, the value of $[(W1-W2)/W2]\times100$ was calculated as the water retention ratio (%).

In the mat forming step, a mat was formed from the plant-based fiber material by the wet method. Specifically, first, 5.5 g of the plant-based fiber material obtained through the aforementioned pulp crushing step was dispersed in 300 g of water to prepare a slurry. Next, the slurry was subjected to suction filtration by using a filter having an inside diameter of 70 mm and filter paper 5A (filter paper of type 5A prescribed in JIS P 3801) (sheet forming).

In the mat forming step, next, after drying the mat formed by the aforementioned sheet forming for 24 hours in a dryer having an inside temperature of 60° C., the mat was allowed to stand still under the conditions of 20° C. and 65% RH to control its humidity. The mat was allowed to stand still for a period of three days. Thereafter, a load of 2 MPa was applied to the mat to pre-press the mat. Note that the pre-pressing was performed without heating. As described above, the mat having a disc shape (and having a diameter of 70 mm) was formed.

In the hot-pressing step, the formed mat was hot-pressed. Specifically, by using a hot-pressing device (product name: "small heat press machine AH-2003C", manufactured by AS ONE Corporation), the hot-pressing was performed or the mat sandwiched between stainless-steel plates under the conditions of a press temperature of 180° C., a press pressure of 30 MPa, and a press time of 10 minutes. Then, after reducing the temperature to 95° C. or less with a load being applied between the stainless-steel plates, a fiberboard obtained by compression molding was taken out. As described above, the fiberboard according to sample 1 was manufactured. When the thickness of the fiberboard was measured, the thickness was 0.95 mm. This result is shown in Table 1 (the thicknesses of the other samples below are also shown in Table 1).

[Samples 2 and 3]

Except that, in a pulp crushing step, the number of beatings performed by using the refiner was 13 (for sample 2) and was 17 (for sample 3) instead of 10 (for sample 1), the fiberboards of samples 2 and 3 were manufactured in the same way as the fiberboard of sample 1.

[Samples 4 and 5]

Except that, in a pulp crushing step, the number of beatings performed by using the refiner was 5 (for sample 4) and was 7 (for sample 5) instead of 10 (for sample 1), and the amount of plant-based fiber material obtained through the pulp crushing step was 13.0 g (for samples 4 and 5) instead of 5.5 g (for sample 1), the fiberboards of samples 4 and 5 were manufactured in the same way as the fiberboard of sample 1.

[Sample 6]

In a pulp crushing step in the manufacturing process of sample 6, the pulp concentration of slurry was 1% (for sample 5) instead of 3% (for sample 1), and crushing was performed by using a millstone-type wet grinder (product name: "supermasscolloider MKCA6-2J", manufactured by MASUKO SANGYO CO., LTD.) instead of a single disc refiner. The number of processing operations in the wet grinder was 1.

From the plant-based fiber material obtained by such a pulp crushing step, the fiberboard of sample 6 was manufactured through a mat forming step and a hot-pressing step similar to those described above with regard to the manufacturing process of sample 1.

[Sample 7]

In a pulp crushing step, a screen having a fractional size of 0.5 mm was used in an impact-type pulverizer (product name: "atomizer MKA-5J", manufactured by MASUKO SANGYO CO., LTD.) to perform dry-crushing. The number of processing operations in the dry grinder was 5.

[Sample 8]

Except that pulp in an unground state and not subjected to the pulp crushing step in the manufacturing process of the fiberboard of sample 1 was subjected as a plant-based fiber material to a mat forming step, the fiberboard of sample 8 was manufactured in the same way as the fiberboard of sample 1.

<Bending Strength>

A test piece having a size of 10 mm×40 mm was cut out from each of the fiberboards of samples 1 to 8, a three-point bending test was performed on each test piece in conformity with JIS A 1408 at a temperature of 60° C. in a dry state, and each bending strength ($N/mm^2$) was measured. The results are shown in Table 1.

<Bending Elastic Modulus>

Regarding each of the fiberboards of samples 1 to 8, each value indicated by an initial gradient of a load-displacement curve obtained in the aforementioned three-point bending test was determined as a bending elastic modulus (GPa). The results are shown in Table 1.

<Specific Gravity in Absolute Dry Condition>

The specific gravity in absolute dry condition of each of the fiberboards of samples 1 to 8 was determined as follows. First, a test piece having a predetermined size was cut out from each fiberboard, and the length, the width, and the thickness of each test piece were measured. From these measured values, the volumes of the test pieces were calculated. Next, after drying the test pieces at a temperature of 105° C. for 24 hours or more, the weights (the weights in absolute dry condition) were measured. Then, by multiplying 100 to each value obtained by dividing the weight in absolute dry condition by the volume of the test piece, the specific gravities in absolute dry condition were calculated.

[Warpage]

The degree of warpage of each of the fiberboards of samples 1 to 8 was measured as follows. Specifically, disc-shaped fiberboards having a diameter of 70 mm were test pieces, and, in each test piece, a maximum displacement from a position (reference position) at which a surface of the test piece can be positioned when there is no warpage at all to a position (position of the surface of the test piece on an inner side of a curve shape) at which the surface of the test piece is actually positioned was defined as the warpage (mm), and the warpage in two directions orthogonal to each other was measured. The measured results are shown in Table 1. Note that, in Table 1, when the warpage per length of 70 mm was 2 mm or less, the measured result was "≤2 mm"; and when the measured result was greater than 2 mm, the measured result was ">2 mm".

[Evaluation]

Each of the fiberboards of samples 1 to 3 is a fiberboard that is obtained by beating pulp, whose particle size D50 is in the range of 50 to 110 μm and whose freeness value is in the range of 150 to 300 ml, and that is manufactured by performing compression molding on the plant-based fiber material containing an adhesive component. The fiberboards of samples 1 to 3 exhibited a significantly higher bending elastic modulus and a significantly higher bending strength compared with those of the fiberboards of samples 4 to 5 that are compression molded products of the plant-based fiber materials having a freeness value greater than 300 ml, the fiberboard of sample 7 that is a compression molded product of the plant-based fiber material obtained by dry-crushing of pulp, and the fiberboard of sample 8 that is a compression molded product of the plant-based fiber material not subjected to crushing.

The warpage of each of the fiberboards of samples 1 to 3 was 2 mm or less, and the warpage was sufficiently suppressed. In contrast, the warpage of the fiberboard of sample 6 that is a compression molded product of the plant-based fiber material obtained by crushing pulp is greater than 2 mm and was significantly larger than the warpages of the fiberboards of samples 1 to 3.

In the manufacturing process of the fiberboard of sample 6, it took as much as approximately 5 hours per 1 kg to perform the aforementioned crushing for producing the plant-based fiber material, and it took as much as approximately 4 hours to perform the sheet forming in the subsequent mat forming step. In contrast, in the manufacturing processes of the fiberboards of samples 1 to 3, the aforementioned beating for producing the plant-based fiber materials containing an adhesive component took only approximately 1 hour per 1 kg of sample 1, only approximately 1.3 hours per 1 kg of sample 2, and only approximately 1.7 hours per 1 kg of sample 3, and it was possible to end the sheet forming in the subsequent mat forming step within a short time (within about 5 minutes).

TABLE 1

| No. | Processing of Raw Material | Processing Machine | Number of Processing Operators [Number of Times] | Particle Size Distribution [μm] D10% | D50% | D90% | CSF [mL] | Water Retention Rate [%] | Thick-ness mm | Bending Strength N/mm$^2$ | Elastic Modulus GPa | Specific Gravity in Absolute Dry Condition | Warp-age [mm] |
|---|---|---|---|---|---|---|---|---|---|---|---|---|---|
| 1 | Beating | Refiner | 10 | 20.2 | 98.2 | 615.3 | 240 | 1865 | 0.95 | 165 | 9.6 | 1.32 | ≤2 |
| 2 | | | 13 | 18.8 | 74.1 | 341.5 | 195 | 1902 | 0.96 | 166 | 9.1 | 1.33 | ≤2 |
| 3 | | | 17 | 17.5 | 68.0 | 334.8 | 185 | 1931 | 0.95 | 161 | 9.0 | 1.33 | ≤2 |
| 4 | | | 5 | Unmeasurable | | | 775 | 1233 | 2.61 | 144 | 9.2 | 1.34 | ≤2 |
| 5 | | | 7 | 23.0 | 115.6 | 703.3 | 435 | 1739 | 2.34 | 149 | 9.1 | 1.34 | ≤2 |
| 6 | Wet-Grinding | Masscolloider | 1 | 18.0 | 73.7 | 338.2 | 70 | 2236 | 1.06 | 161 | 10.5 | 1.34 | 2< |
| 7 | Dry-Crushing | Atomizer | 5 | 10.1 | 42.0 | 190.1 | 562 | 1061 | 1.50 | 120 | 8.4 | 1.33 | ≤2 |
| 8 | Un-processed | — | — | Unmeasurable | | | >800 | 1001 | 1.84 | 83 | 6.9 | 1.26 | ≤2 |

REFERENCE SIGNS LIST

S1 pulp crushing step
S2 mat forming step
S3 hot-pressing step
X fiberboard

The invention claimed is:

1. A fiberboard manufacturing method comprising:

a first step of beating in a gap between opposed blades pulp dispersed in water to thereby produce a plant-based fiber material that has a particle size D50 of 50 to 110 μm and a freeness value of 150 to 300 ml and that contains an adhesive component, wherein the gap is 0.05 to 2.0 mm;

a second step of forming a mat from the plant-based fiber material; and a third step of hot-pressing the mat to form a fiberboard from the mat through a process of plasticizing the adhesive component in the mat.

2. The fiberboard manufacturing method according to claim 1, wherein a water retention rate of the plant-based fiber material that is produced in the first step is 2000% or less.

3. The fiberboard manufacturing method according to claim 1, wherein a particle size D90 of the plant-based fiber material that is produced in the first step is 300 to 700 μm.

4. The fiberboard manufacturing method according to claim 1, wherein, in the first step, the plant-based fiber material is produced by beating pulp having a lignin content ratio of 18 to 35 mass %.

5. The fiberboard manufacturing method according to claim 1, wherein, in the second step, the mat is formed by sheet forming from a slurry prepared by dispersing the plant-based fiber material in water.

6. The fiberboard manufacturing method according to claim 1, wherein, in the third step, the fiberboard is formed from only the plant-based fiber material and the adhesive component.

* * * * *